US011097869B2

(12) United States Patent
Kim

(10) Patent No.: US 11,097,869 B2
(45) Date of Patent: Aug. 24, 2021

(54) ALUMINUM ASSEMBLY PALLET

(71) Applicant: Jin Seop Kim, Pyeongtaek-si (KR)

(72) Inventor: Jin Seop Kim, Pyeongtaek-si (KR)

( * ) Notice: Subject to any disclaimer, the term of this patent is extended or adjusted under 35 U.S.C. 154(b) by 0 days.

(21) Appl. No.: 16/845,439

(22) Filed: Apr. 10, 2020

(65) Prior Publication Data

US 2020/0407111 A1 Dec. 31, 2020

(30) Foreign Application Priority Data

Jun. 25, 2019 (KR) ..... 10-2019-0075477

(51) Int. Cl.
*B65D 19/42* (2006.01)
*B65D 19/00* (2006.01)
*B65D 19/08* (2006.01)

(52) U.S. Cl.
CPC ..... *B65D 19/42* (2013.01); *B65D 19/0093* (2013.01); *B65D 19/08* (2013.01); *B65D 2519/00024* (2013.01); *B65D 2519/00164* (2013.01); *B65D 2519/00273* (2013.01); *B65D 2519/00552* (2013.01); *B65D 2519/00567* (2013.01); *B65D 2519/00641* (2013.01)

(58) Field of Classification Search
CPC ..... B65D 19/06; B65D 19/08; B65D 19/38; B65D 19/0083; B65D 19/0093; B65D 2519/00552; B65D 2519/0024; B65D 2519/0084; B65D 2519/00273; B65D 2519/00292; B65D 2519/00567; B65D 2519/00641
See application file for complete search history.

(56) References Cited

U.S. PATENT DOCUMENTS 2,052,914 A * 9/1936 Williams ..... B60P 3/075 410/9
3,877,671 A * 4/1975 Underwood ..... B61D 45/002 248/346.03
5,259,711 A * 11/1993 Beck ..... B60P 7/0815 410/101
5,941,179 A * 8/1999 Herring ..... B65D 19/0095 108/57.19
6,163,906 A * 12/2000 Kay ..... A61G 7/053 5/658

(Continued)

FOREIGN PATENT DOCUMENTS

KR 101224133 B1 1/2013

*Primary Examiner* — Daniel J Rohrhoff
(74) *Attorney, Agent, or Firm* — Harness, Dickey & Pierce, P.L.C.

(57) ABSTRACT

Disclosed herein is an aluminum assembly pallet. This includes a plurality of upper plates each having a predetermined length, a binding device coupled at an upper end thereof to a lower portion of each upper plate, with a sliding protrusion formed on a lower end of the binding device, and a middle plate disposed under each of the upper plates to be perpendicular thereto and assembled with the binding device. The middle plate includes a sliding groove formed to allow the sliding protrusion to be movable inwards in a longitudinal direction of the middle plate, a plurality of entrance holes formed in an upper end of the sliding groove to allow the sliding protrusion to go in and out, and a connecting hole connecting the entrance holes to each other and having a width that is smaller than a diameter of each of the entrance holes.

5 Claims, 7 Drawing Sheets

(56) References Cited

U.S. PATENT DOCUMENTS

| | | | | |
|---|---|---|---|---|
| 6,766,749 | B2 * | 7/2004 | Lacabanne | B65D 19/0085 108/56.3 |
| 8,424,468 | B2 * | 4/2013 | Aden | B65D 19/0026 108/56.3 |
| 8,739,489 | B2 * | 6/2014 | Weber | E04F 11/1846 52/510 |
| 10,011,390 | B2 * | 7/2018 | Lim | B65D 19/385 |
| 2005/0268824 | A1 * | 12/2005 | Williams, Jr. | B65D 19/0095 108/57.25 |
| 2006/0169185 | A1 * | 8/2006 | Williams, Jr. | B65D 19/0095 108/56.3 |
| 2006/0196394 | A1 * | 9/2006 | Bailey | B65D 19/0048 108/56.1 |
| 2008/0087203 | A1 * | 4/2008 | Hartel | B65D 19/0026 108/57.31 |
| 2009/0095206 | A1 * | 4/2009 | Dacus | B32B 3/12 108/57.27 |
| 2012/0125238 | A1 * | 5/2012 | Johnson | B65D 19/08 108/57.32 |
| 2012/0298015 | A1 * | 11/2012 | Jian | B65D 19/0097 108/56.1 |
| 2014/0000494 | A1 * | 1/2014 | Gysin | B65D 19/0006 108/56.3 |
| 2015/0360808 | A1 * | 12/2015 | Marconel Carpio | B65D 19/0073 108/56.3 |
| 2018/0162588 | A1 * | 6/2018 | Segerstrom | B65D 19/0093 |
| 2019/0283931 | A1 * | 9/2019 | Westendorf | B65D 19/0002 |
| 2019/0322414 | A1 * | 10/2019 | Chan | B65D 19/0002 |
| 2019/0375545 | A1 * | 12/2019 | Su | E05C 3/08 |
| 2020/0239185 | A1 * | 7/2020 | Park | B65D 19/0093 |

* cited by examiner

ALUMINUM ASSEMBLY PALLET

CROSS REFERENCE TO RELATED APPLICATION

The present application claims priority to Korean Patent Application No. 10-2019-0075477, filed Jun. 25, 2019, the entire contents of which are incorporated herein for all purposes by this reference.

BACKGROUND OF THE INVENTION

Field of the Invention

The present invention relates to an aluminum assembly pallet. More particularly, the invention relates to an aluminum assembly pallet that can be easily assembled and disassembled without separate tools or instruments.

Description of the Related Art

Generally, a pallet is used to stably carry various type of cargo, and is usually used to load cargo into transportation means such as airplanes, ships, or vehicles.

Such a pallet mainly includes a plurality of upper plates that are arranged to load cargo, a middle plate that is perpendicularly coupled to the upper plate to serve as a support, and a lower plate that is coupled to the middle plate to be in close contact with the ground.

In the past, such a pallet was usually made of wood. However, recently, a plastic material is also used. In addition, the use of aluminum material that is light but has rigidity is gradually increasing.

Recently, assembly pallets that are highly useful depending on the size or type of cargo are widely used. These assembly pallets have slight differences in assembling method, but most of the assembly pallets adopt an assembling method using a coupling member such as a bolt.

As one of the conventional assembly pallets, Korean Patent No. 10-1224133 (Patent Document 1) has proposed an assembly pallet using a bolt fastening method. The conventional assembly pallet is problematic in that bolt fastening is essentially required for assembling, even when the pallet adopts an assembly structure, and a tool such as a screwdriver should be used for bolt fastening, so that it is very inconvenient to work.

Furthermore, the conventional assembly pallet has structural features requiring a large number (at least 3 or more, usually 5 or more) of upper plates for loading cargo. The conventional assembly pallet is problematic in that it takes a long time to perform an assembly process because the bolt fastening is essentially required for the assembly process due to the above-mentioned structural features.

Moreover, a long assembly time inevitably leads to a long disassembly time.

Documents of Related Art (Patent Document 1) KR 10-1224133 B1 (Dec. 28, 2012)

SUMMARY OF THE INVENTION

The present invention has been made in order to solve the above-mentioned problems in the prior art and an objective of the present disclosure is to provide an aluminum assembly pallet that can be easily assembled and disassembled through a simple manual operation without separate tools because bolt fastening work is never required in both an assembly process and a disassembly process.

In order to achieve the objective of the present invention, the invention provides an aluminum assembly pallet, including: a plurality of upper plates each having a predetermined length; a binding device coupled at an upper end thereof to a lower portion of each of the upper plates, with a sliding protrusion being formed on a lower end of the binding device; and a middle plate disposed under each of the upper plates to be perpendicular thereto and assembled with the binding device, wherein the middle plate may include a sliding groove formed to allow the sliding protrusion to be movable inwards in a longitudinal direction of the middle plate; a plurality of entrance holes formed in an upper end of the sliding groove to allow the sliding protrusion to go in and out; and a connecting hole connecting the entrance holes to each other and having a width that is smaller than a diameter of each of the entrance holes.

Furthermore, the binding device may include a main body having a predetermined length and having a coupling hole formed in an upper end thereof to be coupled to the lower portion of the upper plate; and a lift part coupled to a side of the main body to move up and down, and the sliding protrusion may be formed on a lower end of the main body.

Further, a body fastening recess may be formed in a first end of the main body to be perpendicular to the longitudinal direction, a spring may be installed in the body fastening recess, the lift part may be fitted into the body fastening recess, and the lift part may be moved up and down by the spring.

Furthermore, a coupling protrusion may protrude from a lower end of the lift part.

Further, when the binding device is fastened to the middle plate, the sliding protrusion may be introduced into the sliding groove through the entrance hole, and the coupling protrusion may be located in an upper end of the connecting hole.

When the main body moves, the sliding protrusion may slide in the sliding groove, the coupling protrusion may be located in an upper end of the entrance hole, and the coupling protrusion may be fixedly introduced into the entrance hole by elasticity of the spring.

An aluminum assembly pallet according to the present invention is advantageous in that bolt fastening work is never required in both an assembly process and a disassembly process, so that it is possible to assemble and disassemble the aluminum assembly pallet through a simple manual operation without separate tools.

Furthermore, an aluminum assembly pallet according to the present invention is advantageous in that it is possible to assemble and disassemble the aluminum assembly pallet through only a simple manual operation, thus shortening time required for an assembly process and a disassembly process and consequently leading to economic advantages.

BRIEF DESCRIPTION OF THE DRAWINGS

The above and other objectives, features, and other advantages of the present invention will be more clearly understood from the following detailed description when taken in conjunction with the accompanying drawings, in which.

DETAILED DESCRIPTION OF THE INVENTION

In the description of the present invention, if it is determined that the related art of the present invention unnecessarily makes the gist of the present invention obscure, a detailed description thereof will be omitted.

Since the present invention may be embodied in many different forms, particular embodiments of the invention will be illustrated in the accompanying drawings and described in detail herein. However, the invention should not be construed as limited to the embodiments set forth herein. Rather, all changes that fall within the bounds of the present invention, or the equivalence of the bounds are intended to be embraced by the present invention.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between", "directly between", "adjacent to", or directly adjacent to" should be construed in the same way.

The terminology used herein is for the purpose of describing particular embodiments only and is not intended to be limiting. In the present disclosure, the singular forms are intended to include the plural forms as well, unless the context clearly indicates otherwise. It will be further understood that the terms "comprise", "include", "have", etc. when used in this specification, specify the presence of stated features, integers, steps, operations, elements, components, and/or combinations thereof but do not preclude the presence or addition of one or more other features, integers, steps, operations, elements, components, and/or combinations thereof.

Hereinafter, an aluminum assembly pallet according to the present invention will be described with reference to the accompanying drawings.

Figure 1:
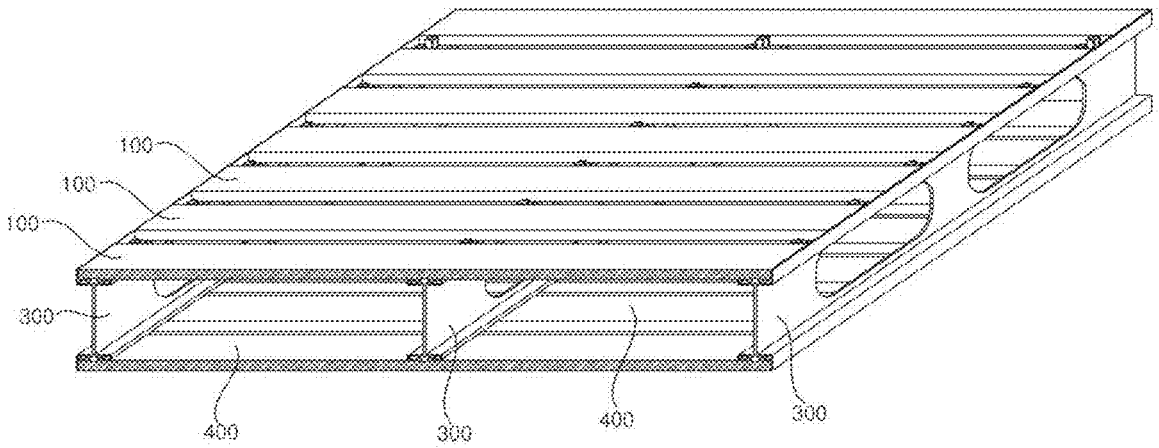
FIG. 1 is a perspective view of an aluminum assembly pallet according to an embodiment of the present invention.
Figure 2:
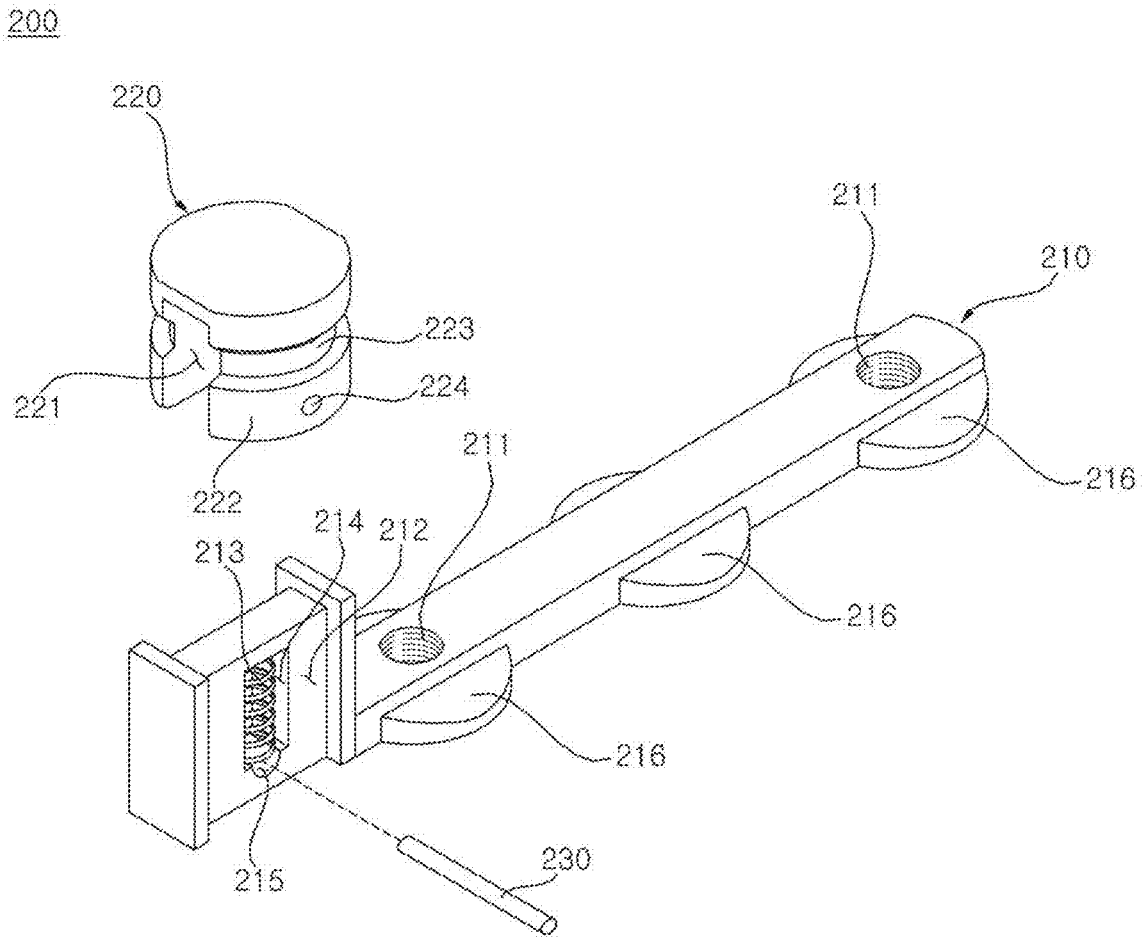
FIG. 2 is a perspective view of a binding device according to an embodiment of the present invention.
Figure 3:
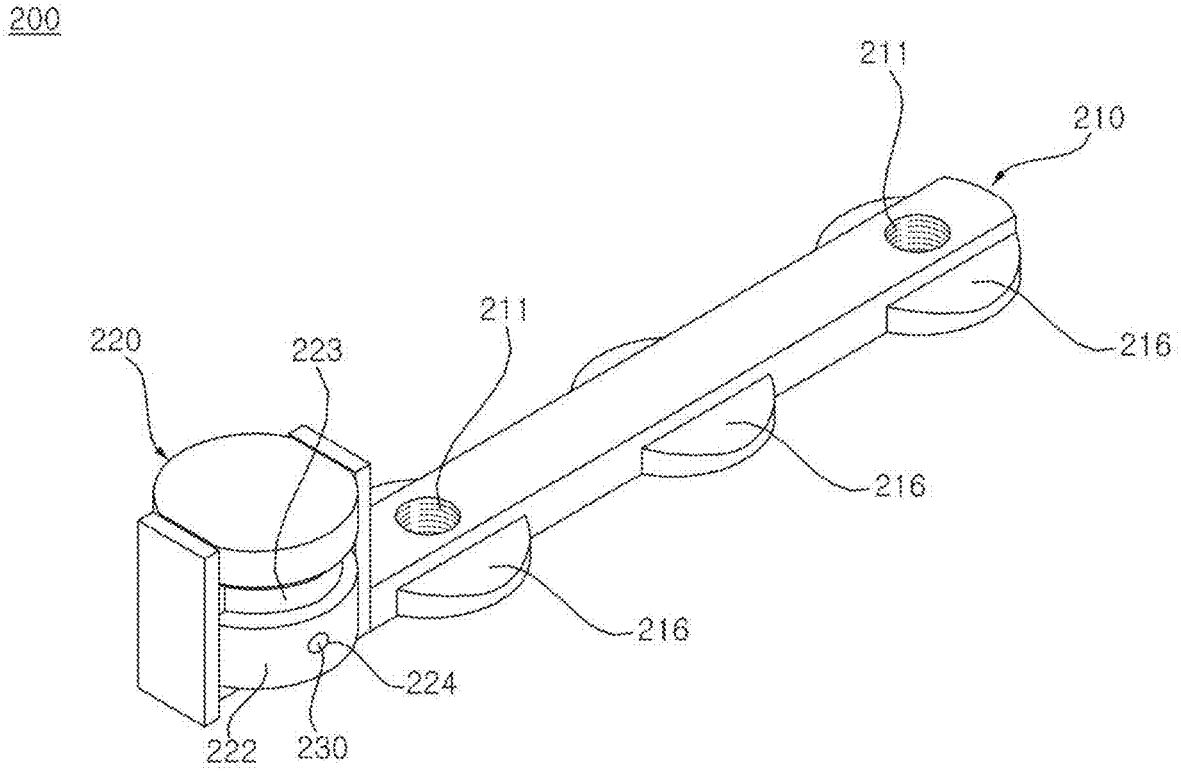
FIG. 3 is an exploded perspective view of the binding device according to the embodiment of the present invention.
Figure 4:
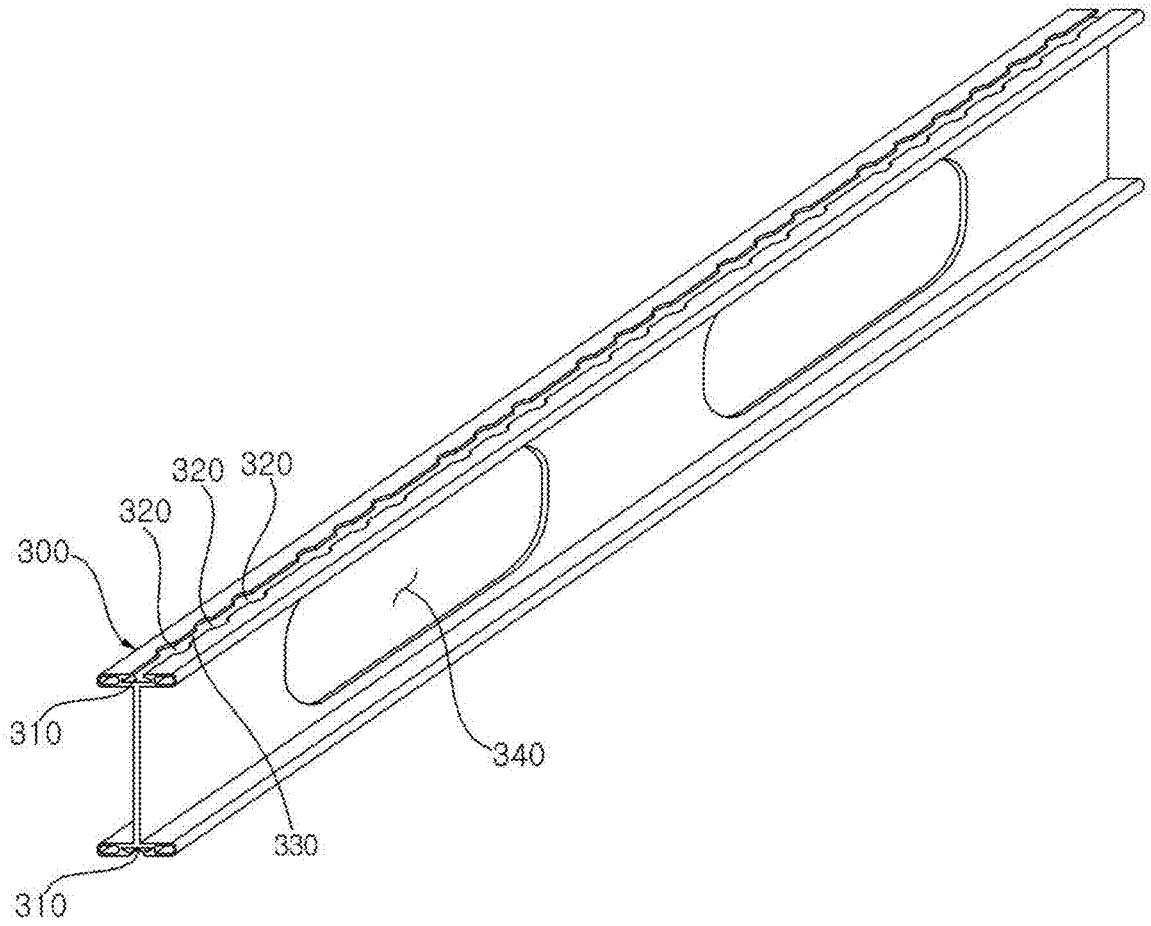
FIG. 4 is a perspective view of a middle plate according to an embodiment of the present invention.
Figure 5:
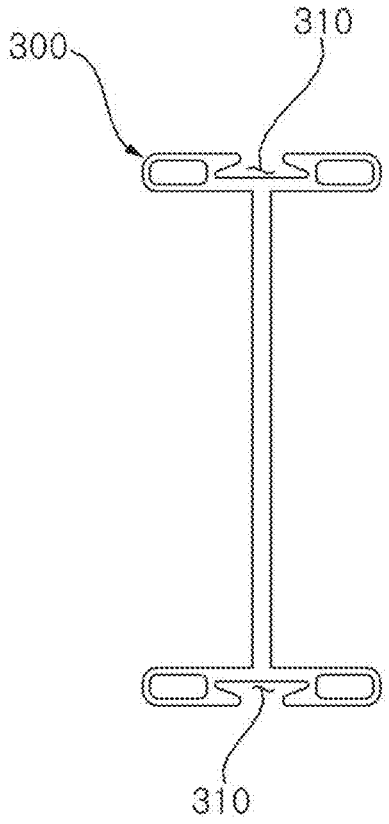
FIG. 5 is a sectional view of the middle plate according to the embodiment of the present invention.

FIG. 1 is a perspective view of an aluminum assembly pallet according to an embodiment of the present invention, FIG. 2 is a perspective view of a binding device according to an embodiment of the present invention, FIG. 3 is an exploded perspective view of the binding device according to the embodiment of the present invention, FIG. 4 is a perspective view of a middle plate according to an embodiment of the present invention, and FIG. 5 is a sectional view of the middle plate according to the embodiment of the present invention.

Referring to FIGS. 1 to 5, the aluminum assembly pallet according to the embodiment of the present invention may include a plurality of upper plates 100 each having a predetermined length, a binding device 200 that is coupled at an upper end thereof to a lower portion of each upper plate 100, with a sliding protrusion 216 being formed on a lower end of the binding device, and a middle plate 300 that is disposed under each upper plate 100 to be perpendicular thereto and is assembled with the binding device 200.

The aluminum assembly pallet of the present invention may further include a lower plate 400 that is coupled to a lower end of the middle plate 300. The lower plate 400 may be installed to correspond to each upper plate 100.

In the present invention, each of the upper plate 100, the middle plate 300, and the lower plate 400 may be made of aluminum. The upper plate 100, the middle plate 300, and the lower plate 400 may be formed through CNC processing or the like. Since aluminum is metal that is light but has rigidity, aluminum is suitable for use as a pallet for loading cargo. When necessary, materials other than aluminum may be used as the material of the upper plate 100, the middle plate 300, and the lower plate 400.

In the present invention, the middle plate 300 may include a sliding groove 310 formed to allow the sliding protrusion 216 to be movable inwards in a longitudinal direction of the middle plate 300, a plurality of entrance holes 320 formed in an upper end of the sliding groove 310 to allow the sliding protrusion 216 to go in and out, and a connecting hole 330 connecting the entrance holes 320 to each other and having a width that is smaller than a diameter of each of the entrance holes 320. Further, a carrier-fork hole 340 may be formed in the middle plate 300 so that a carrier fork is inserted into the hole to lift a cargo.

In the present invention, the binding device 200 may include a main body 210 that has a predetermined length and has a coupling hole 211 formed in an upper end thereof to be coupled to the lower portion of the upper plate 100, and a lift part 220 that is coupled to a side of the main body 210 to move up and down.

Such a binding device 200 includes a body fastening recess 212 that is formed in one end of the main body 210 to be perpendicular to the longitudinal direction. A spring 213 may be installed in the body fastening recess 212. In this regard, the lift part 220 may be fitted into the body fastening recess 212, and the lift part 220 may be moved up and down by the spring 213.

To be more specific, a spring seat 214 may be formed inside the body fastening recess 212, and a spring-pin through groove 215 may be formed in a lower end of the spring seat 214. Here, the spring 213 may be installed in the spring seat 214.

Furthermore, a lift-part fitting groove 221 may be formed from a lower end of the lift part 220 to a middle portion thereof to allow the lift part 220 to be fitted into the body fastening recess 212. A coupling protrusion 222 may also be formed on the lower end of the lift part 220. This coupling protrusion 222 may be fitted into the entrance hole 320 of the middle plate 300.

Furthermore, a spring through hole 224 may be formed in the lower end of the lift part 220 to correspond to the spring-pin through groove 215 of the main body 210. The spring pin 230 may be installed to pass through both the spring through hole 224 of the lift part 220 and the spring-pin through groove 215 of the main body 210.

Such a configuration enables the lift part 220 of the binding device 200 according to the present invention to move up and down. The lift part 220 that has moved up may be moved down to return to its original position by the spring 213.

According to the present invention, the binding device 200 may be coupled to both the upper plate 100 and the middle plate 300. First, the binding device may be coupled to the upper plate 100 in the following manner: a coupling member such as a bolt is fastened to the coupling hole 211 formed in the main body 210 of the binding device 200, so that the binding device 200 and the upper plate 100 may be coupled to each other.

Figure 6:
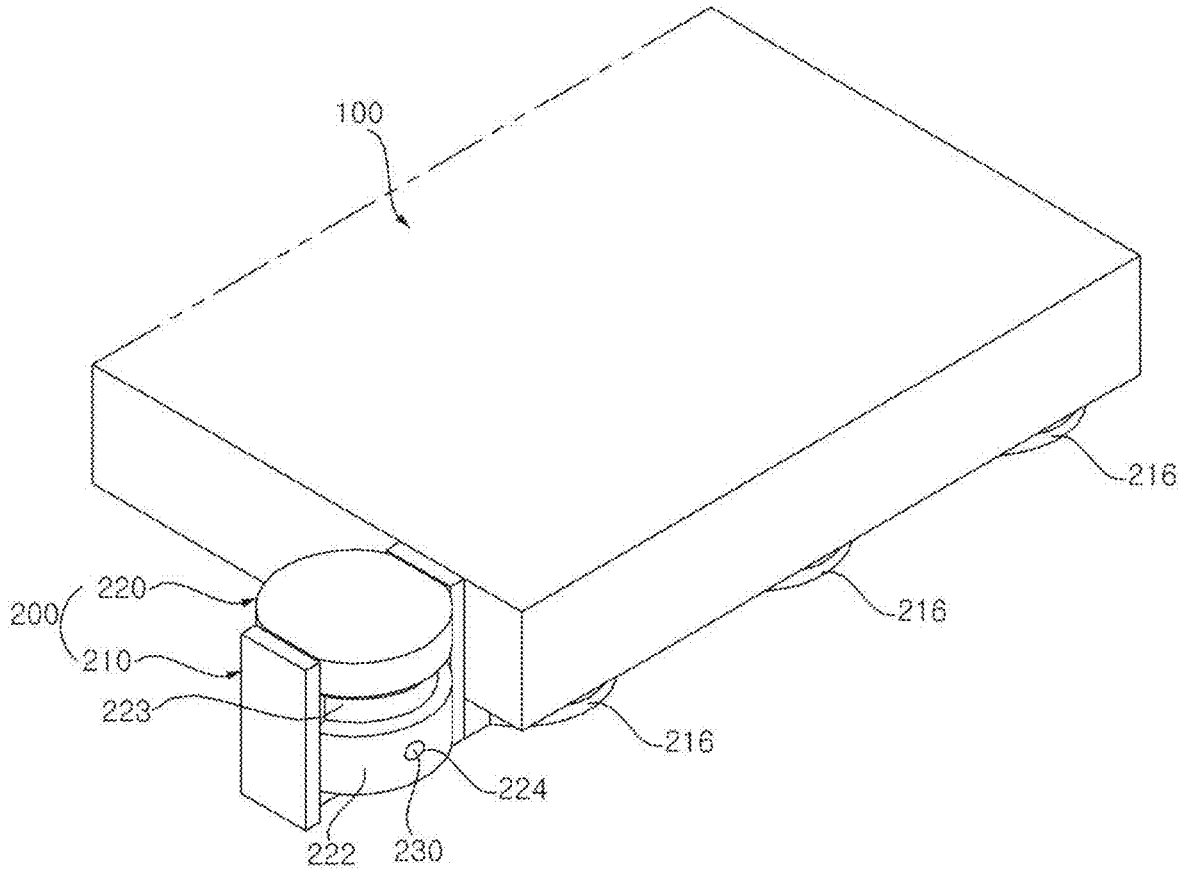
FIG. 6 is a perspective view showing a state in which the binding device and the upper plate according to the embodiment of the present invention are coupled to each other.
Figure 7:
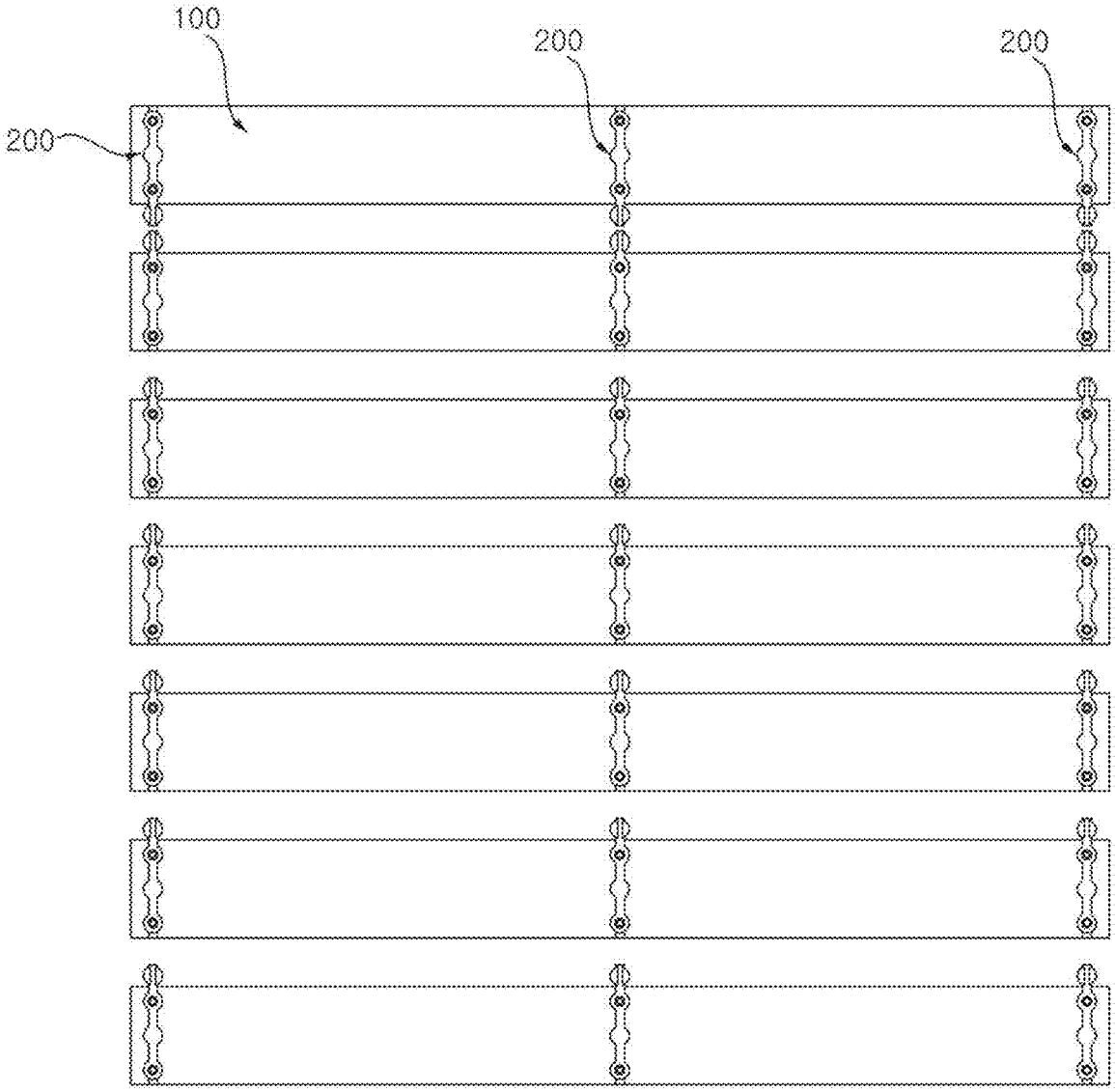
FIG. 7 is a bottom view showing a state in which the binding device and the upper plate according to the embodiment of the present invention are coupled to each other.

FIG. 6 is a perspective view showing a state in which the binding device and the upper plate according to the embodiment of the present invention are coupled to each other, and FIG. 7 is a bottom view showing a state in which the binding device and the upper plate according to the embodiment of the present invention are coupled to each other. Referring to FIGS. 6 and 7, it is possible to check the coupled state of the binding device 200 and the upper plate 100. Three binding devices 200 may be coupled to one upper plate 100.

Next, the binding device 200 may be coupled to the middle plate 300 in the following manner: when the binding device 200 is fastened to the middle plate 300, the sliding protrusion 216 formed on the binding device 200 may be introduced into the sliding groove 310 through the entrance hole 320 of the middle plate 300.

As such, when the sliding protrusion 216 formed on the binding device 200 enters the sliding groove 310 through the entrance hole 320 of the middle plate 300, the coupling protrusion 222 formed on the lift part 220 is located in an upper end of the connecting hole 330 formed in the middle plate 300.

In such a state, after the binding device 200 moves in the longitudinal direction of the middle plate 300, the binding device 200 and the middle plate 300 may be finally coupled to each other. This will be described with reference to FIGS. 8 and 9.

Figure 8:
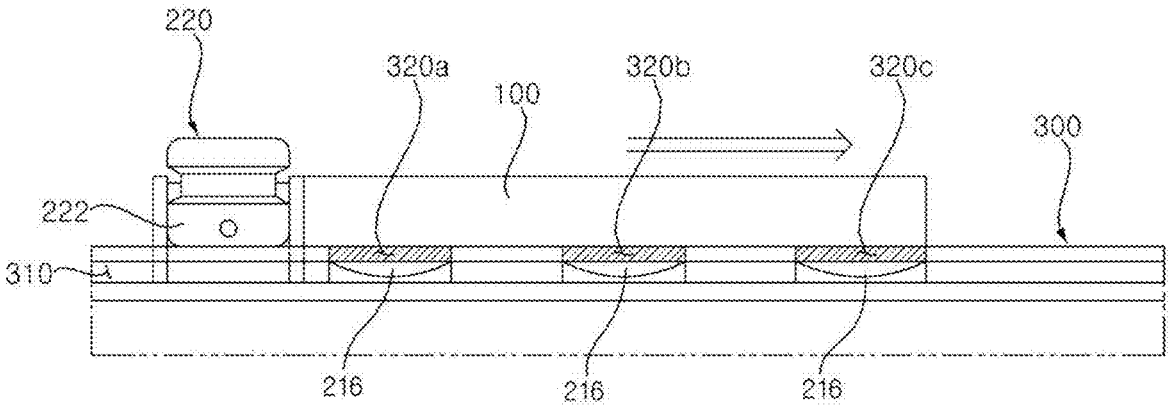
FIGS. 8 and 9 are diagrams illustrating an operation for coupling the binding device and the middle plate according to the embodiment of the present invention to each other.
Figure 9:
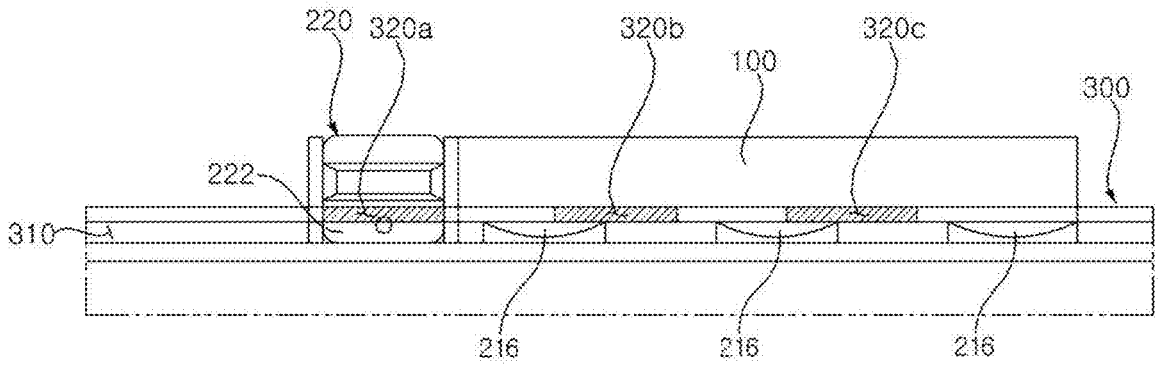

FIGS. 8 and 9 are diagrams illustrating an operation for coupling the binding device and the middle plate according to the embodiment of the present invention to each other.

Referring to FIG. 8, when the binding device 200 is fastened to the middle plate 300, it can be seen that three sliding protrusions 216*a*, 216*b*, and 216*c* formed on the binding device 200 are introduced into the sliding groove 310 through entrance holes 320*a*, 320*b*, and 320*c* of the middle plate 300, and the coupling protrusion 222 formed on the lift part 220 is located in the upper end of the connecting hole 330 formed in the middle plate 300.

FIG. 9 shows a state after the binding device 200 moves in the longitudinal direction of the middle plate 300. Referring to FIG. 9, it can be seen that the lift part 220 is fitted into the entrance hole 320*a*. That is, according to the present invention, the binding device 200 moves in the longitudinal direction of the middle plate 300 in a state where the lift part 220 is located in the upper end of the connecting hole 330. When the lift part 220 is located in the upper end of the entrance hole 320*a* during the movement of the binding device, the lift part 220 moves down in the entrance hole 320*a* due to the presence of the entrance hole 320*a*.

The reason is as follows: the connecting hole 330 is formed in the middle plate 300 to connect the plurality of entrance holes 320 to each other. Here, the connecting hole 330 has a width smaller than the diameter of the entrance hole 320, and the width of the lift part 220 is larger than the width of the connecting hole 330 and is smaller than the diameter of the entrance hole 320.

In other words, according to the present invention, the width of the lift part 220 is larger than the width of the connecting hole 330 and is smaller than the diameter of the entrance hole 320. Thus, when the lift part 220 is located in the upper end of the entrance hole 320*a* while the binding device 200 moves in the longitudinal direction of the middle plate 300, the lift part 220 moves down in the entrance hole 320*a* due to the presence of the entrance hole 320*a*.

According to the present invention, the coupling protrusion 222 is formed on the lower end of the lift part 220. As the lift part 220 moves down from the upper end of the entrance hole 320*a*, the coupling protrusion 222 is fitted into the entrance hole 320*a*. At this time, in the state where the coupling protrusion 222 is fitted into the entrance hole 320*a*, the binding device 200 is fixed. In order to fix the binding device, it is preferable that the section of the coupling protrusion 222 correspond to the entrance hole 320*a* and the height of the coupling protrusion 222 be higher than that of the sliding groove 310 of the middle plate 300.

Referring to FIG. 9, it can be seen that the coupling protrusion 222 is fitted into the entrance hole 320*a*, so that the binding device may no longer be moved in the longitudinal direction of the middle plate 300.

Furthermore, referring to FIG. 9, in the state where the coupling protrusion 222 is fitted into the entrance hole 320*a*, the sliding protrusion 216 formed on the main body 210 of the binding device 200 is located between three entrance holes 320*a*, 320*b*, and 320*c*, so that the binding device may not be moved in a vertical direction and thereby may be fixed.

Consequently, according to the present invention, the width of the coupling protrusion 222 is larger than the width of the connecting hole 330 and is smaller than the diameter of the entrance hole 320. Simultaneously, the height of the coupling protrusion 222 is higher than that of the sliding groove 310 of the middle plate 300. Thus, when the lift part 220 is located in the upper end of the entrance hole 320*a* while the binding device 200 moves in the longitudinal direction of the middle plate 300, the lift part 220 moves down in the entrance hole 320*a* due to the presence of the entrance hole 320*a*. After the lift part moves down, the binding device 200 and the middle plate 300 may be fixed.

As described above, in the aluminum assembly pallet according to the embodiment of the present invention, after the sliding protrusion 216 is located to be fitted into the entrance hole 320 of the middle plate 300, the binding device moves in the longitudinal direction of the middle plate 300, so that the binding device 200 and the middle plate 300 may be assembled with each other. Since the upper plate 100 and the binding device 200 are previously fastened to each other by a fastening member such as a bolt, a worker may assemble the upper plate 100, the binding device 200, and the middle plate 300 with only a simple operation.

Furthermore, in the aluminum assembly pallet according to the embodiment of the present invention, when the binding device 200 and the middle plate 300 are separated from each other, a worker lifts the lift part 220 slightly and then moves the main body 210 in the longitudinal direction of the middle plate 300. Then, the sliding protrusion 216 is located in the entrance hole 320 of the middle plate 300, so that the binding device 200 may be separated from the middle plate 300.

As shown in FIGS. 2 and 3, the aluminum assembly pallet according to the embodiment of the present invention may further include a grip part 223 that is formed in a midsection of the lift part 220 in a groove shape. Such a grip part 223 allows the binding device to be easily gripped by a worker's hand. The formation of the grip part 223 may naturally lead to the coupling protrusion 222.

Furthermore, according to the present invention, the lower plate 400 may be formed to correspond to the upper plate 100, the lower plate 400 and the binding device 200 may be coupled to each other, and the binding device 200 coupled with the lower plate 400 may be coupled to the middle plate 300.

Although the present invention was described with reference to specific embodiments shown in the drawings, it is apparent to those skilled in the art that the present invention may be changed and modified in various ways without departing from the scope of the present invention, which is described in the following claims.

What is claimed is:

1. An aluminum assembly pallet, comprising:

a plurality of upper plates each having a length;

a binding device coupled at an upper end thereof to a lower portion of each of the upper plates, the binding device having a sliding protrusion on a lower end thereof; and a middle plate under each of the upper plates to be perpendicular thereto and assembled with the binding device, wherein the middle plate comprises, a sliding groove configured to allow the sliding protrusion to be movable inwards in a longitudinal direction of the middle plate, a plurality of entrance holes in an upper end of the sliding groove and configured to allow the sliding protrusion to go in and out, and a connecting hole connecting the entrance holes to each other and having a width smaller than a diameter of each of the entrance holes, wherein the binding device comprises, a main body having a length and having a coupling hole in an upper end thereof, the main body configured to be coupled to the lower portion of a corresponding one of the upper plates, and a lift part coupled to a side of the main body and configured to move up and down, and wherein the sliding protrusion is on a lower end of the main body.

2. The aluminum assembly pallet of claim 1, wherein a body fastening recess is in a first end of the main body to be perpendicular to the longitudinal direction, a spring is in the body fastening recess, the lift part is fitted into the body fastening recess, and the lift part is configured to be moved up and down by the spring.

3. The aluminum assembly pallet of claim 1, further comprising:

a coupling protrusion protruding from a lower end of the lift part.

4. The aluminum assembly pallet of claim 3, wherein, when the binding device is fastened to the middle plate, the sliding protrusion is configured to be coupled into the sliding groove through a corresponding one of the entrance holes, and the coupling protrusion is in an upper end of the connecting hole.

5. The aluminum assembly pallet of claim 4, wherein, when the main body moves, the sliding protrusion is configured to slide in the sliding groove, the coupling protrusion is in an upper end of a corresponding one of the entrance holes, and the coupling protrusion is fixedly coupled into the corresponding one of the entrance holes by elasticity of a spring.

* * * * *